United States Patent [19]

Thompson

[11] 4,418,505

[45] Dec. 6, 1983

[54] STARTER STRIP FOR A TILE ROOF

[75] Inventor: Roger D. Thompson, La Canada, Calif.

[73] Assignee: Boral (USA) Inc., Los Angeles, Calif.

[21] Appl. No.: 339,085

[22] Filed: Jan. 13, 1982

[51] Int. Cl.[3] ..... E04B 7/00

[52] U.S. Cl. ..... 52/95; 52/96; 52/518; 52/732

[58] Field of Search ..... 52/94, 95, 97, 518, 52/732, 96, 58

[56] References Cited

U.S. PATENT DOCUMENTS

| | | | |
|---|---|---|---|
| 1,030,590 | 6/1912 | Latulip | 52/518 X |
| 2,097,845 | 11/1937 | Snow | 52/94 X |
| 3,137,970 | 6/1964 | Tiernan . | |
| 3,199,256 | 8/1965 | Considder | 52/98 |
| 3,415,020 | 12/1968 | Windle | 52/96 |
| 3,665,663 | 5/1972 | Scherer . | |
| 3,967,419 | 7/1976 | Robinson . | |

FOREIGN PATENT DOCUMENTS

| | | | |
|---|---|---|---|
| 1933534 | 2/1971 | Fed. Rep. of Germany | 52/94 |

*Primary Examiner*—Carl D. Friedman

*Attorney, Agent, or Firm*—Burns, Doane, Swecker & Mathis

[57] ABSTRACT

A starter strip is adapted for use on a tile roof of the type comprising a waterproof underlayment and possibly a plurality of battens disposed upon the waterproof underlayment and extending parallel to the eave course of the roof. A covering of tiles is disposed upon the battens such that head ends of the tiles rest upon the battens and nose ends of the tiles rest upon the head ends of the next lower tiles. The starter strip extends along the eave course to support the nose ends of the eave course tiles. The starter strip comprises a base portion, a cover portion extending downwardly from a front edge of the base portion to overlie an exposed portion of the roof, and a riser portion extending upwardly from the front edge of the base portion. The nose ends of the eave course tiles rests upon the bent-back upper edge of the riser portion. A lower edge of the waterproof underlayment extends over the base portion to cover the anchoring nails. The riser portion includes a plurality of spaced drainage apertures extending completely through the riser portion immediately above the juncture of the latter with the base portion.

13 Claims, 3 Drawing Figures

Fig. 1
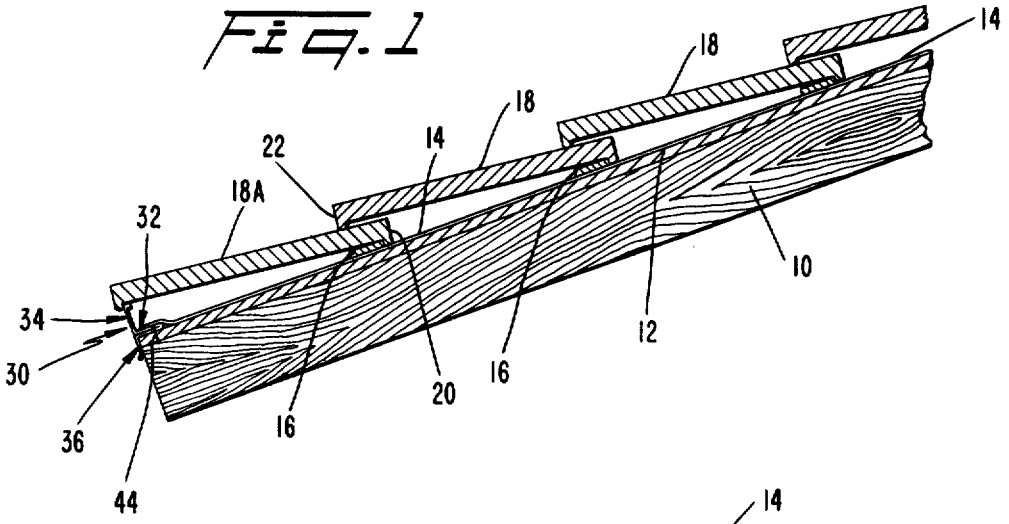
Fig. 2
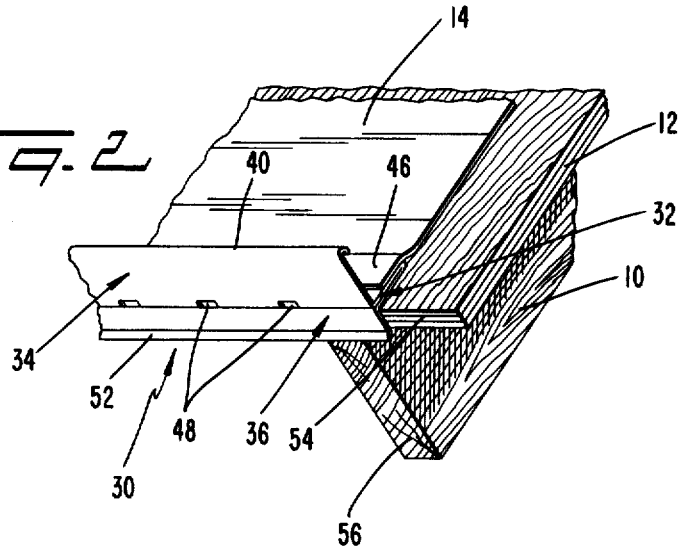
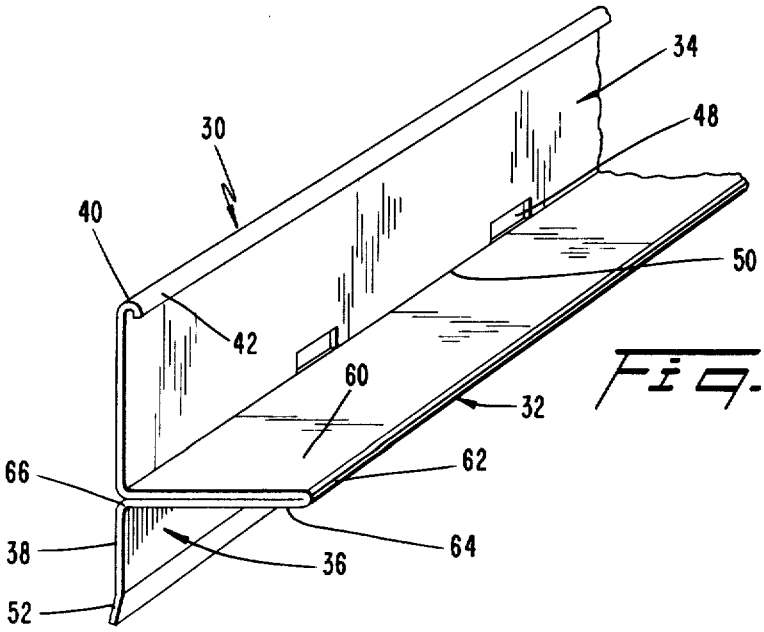
Fig. 3

STARTER STRIP FOR A TILE ROOF

BACKGROUND AND OBJECTS OF THE INVENTION

The present invention relates to tile roofing and, in particular, to the supporting of tiles along an eave concourse of a roof.

Tiles used in tile roofing have traditionally been laid such that their upper or head ends are directly supported by the solid sheathing or by battens placed on the sheathing in parallel relation to the eave edge of the roof, and their lower or nose ends rest upon the head end of the next lower tile. Thus, all of the tiles are coplanar. A rib-and-groove connection between adjacent tiles helps retain the tiles in position.

It will be appreciated that the nose ends of the lowermost tiles, i.e., those disposed along each eave edge or eave course of the roof have no tiles on which to rest. Therefore, in order to support the nose ends of such eave course tiles, it has been customary to secure an elongate wooden starter board to the roof sheathing beneath such nose ends, or to provide a raised fascia board, upon which the nose ends can rest. Both of those arrangements, however, involve a drawback as relates to water drainage. That is, the starter board and fascia board create water dams at the eave line which can lead to rotting of the wood.

It has been heretofore proposed in U.S. Robinson Pat. No. 3,967,419 issued on July 6, 1976, to provide a water gutter with an upstanding wall upon which the nose ends of the eave course tiles may rest. Although not expressly stated therein, it is presumed that water-damming is to be avoided by extending the lower edge of the waterproof felt material to the top of the wall. However, this portion of the felt material is unsupported from beneath and could rupture under the weight of an appreciable water build-up. Also, the area beneath the raised end of the felt is exposed to a greater extent and increases the chances for damage to occur if water enters this area.

It has also been heretofore proposed in U.S. Tiernan Pat. No. 3,137,970 issued June 23, 1964, to support eave course shingles (not tiles) by means of a starter strip having a base mounted to the roof sheathing and an upstanding lip on which the shingles rest. Disposed behind the lip, the strip has a plurality of ridges extending parallel to the eave course and which also support the shingles. Seals are created by contact of the undersides of the shingles with these ridges in order to prevent the rearward migration of water. However, such line seals disadvantageously tend to dam-up downwardly flowing water.

It is, therefore, an object of the present invention to minimize or obviate problems of the type discussed above.

Another object is to enable the eave course tiles of a roof to be securely supported without presenting the danger of water dam-ups.

A further object is to provide a strong, yet relatively inexpensive, easily fabricated starter strip which supports roofing tiles and allows for the escape of water.

SUMMARY OF THE INVENTION

These objects are achieved by the present invention which involves a starter strip for use in a tile roof. In use of the invention, the roof is of the type comprising a sheathing, a waterproof underlayment disposed upon the sheathing, and a covering of tiles disposed atop the underlayment such that nose ends of the tiles rest upon the head ends of the next lower tiles. The starter strip extends along the eave course to support the nose ends of the eave course tiles. The starter strip comprises a base portion supported atop the sheathing, a cover portion extending downwardly from a front edge of the base portion to overlie an exposed portion of the roof, and a riser portion extending upwardly from the front edge of the base portion. The nose ends of the eave course tiles rest upon an upper edge of the riser portion. A lower edge of the waterproof underlayment extends over the base portion. The riser portion includes a plurality of spaced drainage apertures extending completely through the riser portion immediately above the junction of the latter with the base portion so that water traveling downwardly along the underlayment beneath the tiles travels over the base, drains through the apertures, and gravitates along an exposed face of the cover portion.

Preferably, the underlayment is mounted such that a lower edge of the underlayment extends over the base portion of the starter strip to cover fasteners which anchor the base portion to the sheathing.

THE DRAWINGS

These objects and advantages of the invention will become apparent from the following detailed description of a preferred embodiment thereof, in connection with the accompanying drawings in which like numerals designate like elements, and in which:

FIG. 1 is a longitudinal sectional view taken through a tile roof in a direction perpendicular to the eave course of the roof, depicting the manner in which tiles are arranged and wherein the eave course tiles are mounted upon a riser strip according to the present invention;

FIG. 2 is a perspective view of the roof, depicting the manner of installing the starter strip; and FIG. 3 is a perspective view of a portion of a starter strip according to the present invention.

DETAILED DESCRIPTION OF A PREFERRED EMBODIMENT OF THE INVENTION

In FIG. 1, there is depicted a cross-sectional view through a tile roof which comprises a plurality of rafters 10 extending perpendicularly to the eave course of the roof (i.e., the lower horizontal edge of the roof). A solid wood sheathing 12 is disposed atop the rafters, and a waterproof underlayment 14, of a conventional felt material, for example, is secured upon the sheathing.

A plurality of wooden battens 16 are attached upon the underlayment and extend parallel to the eave course of the roof.

The tiles, which may be formed of fired clay, stone, concrete, etc., are of conventional flat design. An upper or head end of each tile includes a depending lug 20 which hooks around a rear side of a respective batten 16. A lower or nose end 22 of the next upper tile rests upon that head end.

It will be appreciated that when laying the eave course tiles 18A (i.e., the left-hand tiles in FIG. 1), it is necessary to raise-up the nose end of such eave course tiles to oreient the latter parallel to the other tiles.

In accordance with the present invention, there is provided a starter strip 30 which so orients the eave course tiles 18A. The starter strip 30 comprises a base portion 32, a riser portion 34, and a cover portion 36. The riser and base portions 34, 36 extend transversely in different directions from a front end of the base portion 32, the riser portion 34 extending upwardly and the cover portion extending downwardly.

The starter strip 30 is mounted on the roof such that the base portion lies flush upon the sheathing 12 and an upper section 38 of the cover portion 36 bears against end edges of the rafters 10.

The riser portion 34 extends upwardly from the sheathing 12 a distance equaling the combined thickness of the underlayment 14, a batten 16, and a tile 18.

The upper edge 40 of the riser portion 34 reverses back at 42 to define a reinforced edge capable of supporting the tiles (which may weigh as much as 10 pounds apiece).

With the base portion mounted, as by means of nails 44 driven through the base portion and into the sheathing 12, the underlayment is installed such that the lower edge 46 thereof extends over the base portion 32 of the starter strip at least far enough to cover the nails 44. Thus, any moisture collecting upon the underlayment gravitates downwardly onto the starter strip and cannot migrate through the nail holes.

In order to prevent the accumulation of dammed-up water, the riser portion 34 has a series of drainage apertures 48 extending completely therthrough immediately above the junction 50 between the riser portion 34 and the base portion 32. Thus, the water drains through those apertures 48 and downwardly along the exposed front face of the cover portion 38.

The lower end 52 of the cover portion is inclined slightly downwardly away from the edges 54, 56 of the sheathing 12 and rafters 10 so that the water spills forwardly thereof.

The strip 30 can be formed of any suitable corrosion resistant material, such as galvanized metal with a baked-on enamel coating. It is most preferable that the strip 30 be formed of a single piece of metal which is bent into the desired configuration. In this regard, the riser portion 34 is bent about 90 degrees at the junction 50 between the riser portion 34 and the base portion 32. Thus, a first or upper section 60 of the base portion 32 extends away from the riser portion 34 and is bent back 180 degrees at 62 to form a second or lower section 64. The second section 64 extends back toward the cover portion beneath the upper section 60 and is bent about 90 degrees at the junction 66 between the cover portion 36 and the base portion 32.

The upper and lower sections 60, 64 of the base portion 32 is disposed in planar contact with one another.

It will be appreciated that in some roof structures there may be provided a fascia board (not shown) extending along the lower end edges of the rafters 10 perpendicularly to the rafters 10. In such a case, the starter strip 30 will be installed such that the cover portion 36, 38 abuts against a front surface of the fascia board and the base portion 32 covers the interface between the fascia board and the end of the rafters 10. Thus, no water can seep through and into such interface.

In some roofs, no battens are provided. Rather, the tiles are laid upon the underlayment. The strip 30 is suitable for use on such a roof.

It will be appreciated that the present invention enables the eave concourse tiles to be securely supported while the problem of wood rotting along the eaves of the roof is minimized. The riser portion 34 and its reinforced upper edge 40, 42 amply supports the relatively heaving loading imposed by the eave concourse tiles. Water beneath the tiles drains through the drain apertures 48. Since the lower end of the underlayment 14 extends over the base portion 32 of the starter strip and covers the nails 44, the chances for water to reach the sheathing 12 are minimized.

Although the invention has been described in connection with a preferred embodiment thereof, it will be appreciated by those skilled in the art that additions, substitutions, modifications and deletions not specifically described, may be made without departing from the spirit and scope of the invention as defined in the appended claims.

What is claimed is:

1. In a tile roof the type comprising a sheathing, a waterproof underlayment disposed upon the sheathing, a covering of tiles disposed atop the underlayment such that nose ends of the tiles rest upon the head ends of the next lower tiles, and a starter strip extending along the eave course to support the nose ends of the eave course tiles, said starter strip comprising a base portion having a lower surface supported atop said sheathing and an upper surface, a cover portion extending downwardly from a front edge of said base portion to overlie an exposed portion of said roof, said cover portion including an exposed front face facing away from said base portion, and a riser portion extending generally upwardly from said front edge of said base portion, the nose ends of said eave course tiles resting upon an upper edge of said riser portion, a lower edge of said waterproof underlayment extending over said base portion, and said riser portion including a plurality of spaced drainage apertures extending completely through said riser portion immediately above the junction of the latter with said base portion to communicate said upper surface of said base portion with said exposed front face of said cover portion, such that water traveling downwardly along said underlayment beneath said tiles travels over said base, drains through said apertures, and gravitates along the exposed face of said cover portion.

2. Apparatus according to claim 1, wherein said upper edge of said riser portion reverses back to define a reinforced edge on which said eave concourse tiles rest.

3. Apparatus according to claim 2, wherein said starter strip comprises a solid piece of metal bent at the junction between said riser portion and said base portion to form a first section of said base portion extending away from said riser portion and bent back 180 degrees to form a second section extending back toward said cover portion, said second section being bent at the junction between said cover portion and said base portion, said first and second sections disposed in planar contact with each other, said upper edge of said riser portion being bent back to define said reinforcing edge.

4. Apparatus according to claim 3, wherein said first and second sections of said base portion lie flush against one another.

5. Apparatus according to claim 3, wherein said drainage apertures lie flush with said upper surface of said base portion, said first and second sections of said base portion lie flush against one another.

6. Apparatus according to claim 1, wherein said starter strip is anchored by fasteners extending through said base portion and into said sheathing, a lower end of said underlayment extending over said base portion sufficiently to cover said fasteners.

7. Apparatus according to claim 1 including a plurality of battens mounted on said underlayment and extending parallel to said eave course, the tiles including head ends having lugs which hook around respective ones of said battens.

8. Apparatus according to claim 1, wherein said riser portion and said cover portion each comprises a solid piece of metal, said drainage apertures extending completely through said solid piece of metal defining said riser portion.

9. Apparatus according to claim 1, wherein said drainage apertures lie flush with said upper surface of said base portion.

10. A starter strip for a tile roof for supporting the nose ends of eave course tiles, said starter strip comprising a base portion having an upper surface and a lower surface adapted to rest atop a roof sheathing, a cover portion extending transversely from a forward edge of said base portion, said cover portion including an exposed front face, and a riser portion extending trasversely from said forward edge in a generally upward direction generally opposite said cover portion, an upper edge of said riser portion reversing back to define a reinforced edge capable of supporting a tile, and a plurality of water drainage apertures extending completely through said riser portion immediately above the junction of the latter with said base portion to communicate said upper surface of said base portion with said exposed front face of said riser portion, said strip comprising a solid piece of metal bent at the junction between said riser portion and said base portion to form a first section of said base portion extending away from said riser portion and bent 180 degrees to form a second section extending back toward said cover portion, said second section being bent at the junction between said cover portion and said base portion, said first and second sections disposed in planar contact with each other, said upper edge of said riser portion being bent back to define said reinforcing edge.

11. A starter strip according to claim 10, wherein said drainage apertures lie flush with said upper surface of said base portion.

12. A starter strip according to claim 10, wherein said first and second sections of said base portion lie flush against one another.

13. A starter strip according to claim 10, wherein said drainage apertures lie flush with said upper surface of said base portion, said first and second sections of said base portion lie flush against one another.

* * * * *